US011041411B2

(12) United States Patent
Kramer et al.

(10) Patent No.: US 11,041,411 B2
(45) Date of Patent: Jun. 22, 2021

(54) CAMSHAFT ADJUSTING SYSTEM WITH MEANS FOR CATCHING HYDRAULIC FLUID DRAINING FROM A VALVE IN ORDER TO DIRECTLY RECIRCULATE THE FLUID INTO THE CAMSHAFT ADJUSTER

(71) Applicant: Schaeffler Technologies AG & Co. KG, Herzogenaurach (DE)

(72) Inventors: Stefan Kramer, Hochstadt/Aisch (DE); Olaf Boese, Nuremberg (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/078,418

(22) PCT Filed: Mar. 9, 2017

(86) PCT No.: PCT/DE2017/100187
§ 371 (c)(1),
(2) Date: Aug. 21, 2018

(87) PCT Pub. No.: WO2017/162233
PCT Pub. Date: Sep. 28, 2017

(65) Prior Publication Data

US 2019/0048765 A1 Feb. 14, 2019

(30) Foreign Application Priority Data

Mar. 23, 2016 (DE) ..... 102016204779.5

(51) Int. Cl.
*F01L 1/344* (2006.01)
*F15B 15/12* (2006.01)

(52) U.S. Cl.
CPC ..... *F01L 1/3442* (2013.01); *F15B 15/12* (2013.01); *F01L 2001/34423* (2013.01);
(Continued)

(58) Field of Classification Search
CPC ..... F01L 1/3442; F01L 2001/34483; F01L 2001/34436; F01L 2001/34423;
(Continued)

(56) References Cited

U.S. PATENT DOCUMENTS 8,215,273 B2 7/2012 Bayrakdar
8,973,544 B2 3/2015 Busse et al.
(Continued)

FOREIGN PATENT DOCUMENTS

DE 102007020525 11/2008
DE 102012201567 3/2013
(Continued)

OTHER PUBLICATIONS

DE 102013212942 english langauge machine translation.*

*Primary Examiner* — Patrick Hamo
*Assistant Examiner* — Wesley G Harris
(74) *Attorney, Agent, or Firm* — Volpe Koenig

(57) ABSTRACT

The invention relates to a camshaft adjusting system (1) for an internal combustion engine of a motor vehicle, including a hydraulic camshaft adjuster (2) which has a stator (3), a rotor (4) that is rotatably mounted in the stator (3), and a hydraulic control system (6) that has a valve (5). The rotor (4) has at least one vane which protrudes into a pressure chamber formed between the rotor (4) and the stator (3) such that the pressure chamber is divided into two sub-chambers, each of which interacts with the hydraulic control system (6) such that a hydraulic pressure ratio is established between the two sub-chambers, said ratio specifying a relative rotational position between the rotor (4) and the stator (3), and is adjusted on the basis of the position of the valve (5). The camshaft adjusting system also includes an actuator (7) which is arranged adjacently in the axial direction of the camshaft adjuster (2) and which acts on the valve (5) for
(Continued)

adjusting purposes. A hydraulic fluid section (8) is arranged on an actuator (7) face facing the camshaft adjuster (2), with this hydraulic fluid section (8) being designed to deflect a flow of hydraulic fluid exiting the valve (5) into the surroundings of the camshaft adjuster (2) back into the camshaft adjuster (2) in an operational state.

5 Claims, 3 Drawing Sheets

(52) U.S. Cl.
CPC ..... *F01L 2001/34433* (2013.01); *F01L 2001/34436* (2013.01); *F01L 2001/34483* (2013.01)

(58) Field of Classification Search
CPC ... F01L 2001/34433; F01L 2001/34426; F01L 2001/3443; F15B 15/12
USPC ..... 123/90.17, 90.15
See application file for complete search history.

(56) References Cited

U.S. PATENT DOCUMENTS

| | | | | |
|---|---|---|---|---|
| 8,991,346 | B2 | 3/2015 | Kinouchi | |
| 2011/0259289 | A1* | 10/2011 | Fujiyoshi | F01L 1/3442 123/90.15 |
| 2014/0150742 | A1 | 6/2014 | Kinouchi | |
| 2016/0169060 | A1* | 6/2016 | Fischer | F01L 1/3442 123/90.17 |

FOREIGN PATENT DOCUMENTS

| | | | | |
|---|---|---|---|---|
| DE | 102013223112 | | 6/2014 | |
| DE | 102013022320 | | 1/2015 | |
| DE | 102013212942 | | 1/2015 | |
| DE | 102013217519 | A1 * | 3/2015 | F01L 1/3442 |
| DE | 102016216363 | A1 * | 10/2017 | F01L 1/3442 |
| EP | 2690261 | A2 * | 1/2014 | F01L 1/3442 |
| EP | 2927440 | | 10/2015 | |
| JP | 2011-094491 | A | 5/2011 | |

* cited by examiner

CAMSHAFT ADJUSTING SYSTEM WITH MEANS FOR CATCHING HYDRAULIC FLUID DRAINING FROM A VALVE IN ORDER TO DIRECTLY RECIRCULATE THE FLUID INTO THE CAMSHAFT ADJUSTER

BACKGROUND

The invention relates to a camshaft adjusting system for an internal combustion engine, for example, a diesel or gasoline engine, of a motor vehicle, such as a passenger car, truck, bus, or agricultural commercial vehicle, comprising a hydraulic camshaft adjuster (of the vane cell type) which has a stator, a rotor that is rotatably mounted/held in the stator, and a hydraulic control system that comprises a valve, wherein the rotor has at least one vane which extends into a pressure chamber formed between the rotor and the stator such that this pressure chamber is divided into two sub-chambers, each of which interacts with/is connected to the hydraulic control system such that a hydraulic pressure ratio is applied between the two sub-chambers, said ratio specifying a relative rotational position between the rotor and the stator, that is adjusted on the basis of the position of the valve, wherein the camshaft adjusting system also comprises an actuator which is arranged adjacently in the axial direction of the camshaft adjuster and which acts on the valve for adjusting purposes. The camshaft adjusting system is therefore also designated as an assembly set/arrangement consisting of a camshaft adjuster and an actuator actuating this camshaft adjuster.

Camshaft adjusting systems according to the class have been known from the prior art for a long time. For example, DE 10 2007 020 525 A1 discloses a camshaft adjuster for an internal combustion engine that is mounted on one end on a camshaft and acts as a transmission element to a drive wheel for the rotational drive of the camshaft. The camshaft adjuster has an inner gear arranged rotationally locked to the camshaft and a coaxially arranged outer gear that can rotate relative to the inner gear, wherein a control valve with a valve slide is provided coaxial to the inner gear, wherein this control slide is provided for controlling a fluid for loading pressure chambers arranged between the inner gear and the outer gear, in order to adjust the angle between the inner gear and the outer gear. The inner gear has a central valve slide space that extends axially toward the camshaft and holds the valve slide so that it can move axially and has at least one control edge with which the valve slide interacts to form a seal.

In these known camshaft adjusting systems, the hydraulic fluid, preferably oil, draining from the valve of the camshaft adjuster, for example, through the T-port, usually runs directly back into a tank that usually causes relatively long delivery distances of the hydraulic fluid. In order to make the hydraulic fluid available again for delivery after draining into the tank, an oil pump is required, because there is no intermediate reservoir provided for adjusting the rotor relative to the stator, wherein this reservoir provided hydraulic fluid/oil to the camshaft adjuster for adjustment procedures. Due to this long delivery system, the inertia of the system is also relatively high.

SUMMARY

Therefore, the object of the present invention is to eliminate these disadvantages known from the prior art and especially to disclose a camshaft adjusting system in which draining hydraulic fluid is made available again on the shortest possible paths for adjusting the camshaft adjuster.

This objective is achieved according to the invention in that a hydraulic fluid guide section is arranged on a (preferably axial) side of the actuator facing the camshaft adjuster, wherein this hydraulic fluid guide section is formed so that a flow of hydraulic fluid existing from the valve into the surroundings of the camshaft adjuster is deflected/guided back into the camshaft adjuster in an operational state.

In this way, the actuator is used directly as a guide part that is otherwise mounted in the camshaft adjusting system, in order to deflect the corresponding flow of hydraulic fluid in the desired direction.

Additional advantageous embodiments are explained in more detail below.

If the hydraulic fluid guide section is arranged/mounted housing-fixed on the actuator, the hydraulic fluid guide section is always positioned at a certain distance relative to the camshaft adjuster, independent of the position of the valve. In this way, the flow of hydraulic fluid is reliably and reproducibly guided in every operational state.

The hydraulic fluid guide section is preferably mounted/arranged directly on an actuator housing of the actuator or is connected to a bearing unit that is held fixed in the actuator housing and guides a tappet of the actuator in the direction that it can move. For a construction of the actuator as a magnetic actuator, it is especially advantageous if the bearing unit is a direct component of a pole core of this actuator. In this way, the configuration is significantly simplified.

It is further advantageous if the hydraulic fluid guide section is constructed by an individual/materially integrated deflection plate mounted on the actuator. The term "plate" should not be understood here to limit the materials to a metal, but only in the sense that the deflection plate has a thin-walled construction. The deflection plate is definitely preferably made from a metal (as a metal plate), but could alternatively also be made from a plastic material. Through this construction of the hydraulic fluid guide section, existing actuators and also actuators already being produced in series production can be easily adapted, which also has positive effects on the production costs.

It is also advantageous if the actuator has a tappet that is guided so that it can move in a bearing unit of the actuator and the hydraulic fluid guide section is alternatively a materially integrated component of this bearing unit. Then the construction of a separate guide plate can be eliminated, and the existing outer contour of the actuator can be used directly as the hydraulic fluid guide section. In this way, the number of components is further reduced.

In this context, it is especially advantageous if the bearing unit is constructed in turn as a pole core or comprises this pole core that has a shifting effect on the tappet. In this way, the actuator has an especially effective action as a magnetic actuator.

It is also preferred if the hydraulic fluid guide section has a ring-shaped collar oriented in the axial direction toward the camshaft adjuster, wherein this collar is arranged so that it deflects the flow of hydraulic fluid existing from the valve into the surroundings of the camshaft adjuster toward the camshaft adjuster in the axial direction. In this way, the flow of hydraulic fluid is guided on especially short paths.

In this context, it is also advantageous if a collection plate forming a hollow space is mounted on a stator-fixed area of the camshaft adjuster, wherein this collection plate covers the hydraulic fluid guide section radially from the outside in the axial direction by a certain distance. In this way, due to the rotation of the camshaft adjuster in its operational state, the hydraulic fluid can be guided directly by the effective centrifugal force reliably back to the camshaft adjuster.

It is also advantageous if the hollow space is coupled/can be coupled hydraulically by a non-return valve that is preferably constructed as a non-return flap to a reservoir formed/mounted in the rotor and/or stator. The reservoir is preferably arranged hydraulically, in turn, between the sub-chambers and the valve, so that it can have a supporting effect on building up pressure in the respective sub-chamber in each position of the valve. In this way, the camshaft adjuster is especially effective.

It is also advantageous if a return spring pretensioning the rotor relative to the stator in a rotational direction is arranged in the hollow space that is formed by the collection plate. In this way, the collection plate can be used simultaneously as a protective cover for this return spring.

If the valve is a central valve that is held/arranged radially within the rotor, the flow of hydraulic fluid is integrated in a hydraulic circuit in an especially clever way.

Furthermore, it is advantageous if the valve is constructed so that, in a first position of a control slide of the valve, a first sub-chamber is opened hydraulically to the surroundings and in a second position of the control slide, a second sub-chamber is opened hydraulically to the surroundings. In this way, in both positions, the hydraulic fluid can be guided effectively by the hydraulic fluid guide section and fed back to the camshaft adjuster.

Expressed in other words, a device for collecting hydraulic fluid/oil for camshaft adjustments is provided. The system according to the invention relates to a central valve and to a central magnet for camshaft adjustments (VIP/"smart phaser"). The design according to the invention has an oil guide contour (the hydraulic fluid guide section) that is arranged on the central valve body (actuator housing) or on the C-pole of the magnet.

BRIEF DESCRIPTION OF THE DRAWINGS

The invention will now be explained in more detail below with reference to figures in which context various embodiments will also be described.

Shown are.

DETAILED DESCRIPTION

The figures are only of a schematic nature and are used only for understanding the invention. The same elements are provided with the same reference symbols. The different features of the different embodiments can also be freely combined with each other.

Figure 1:
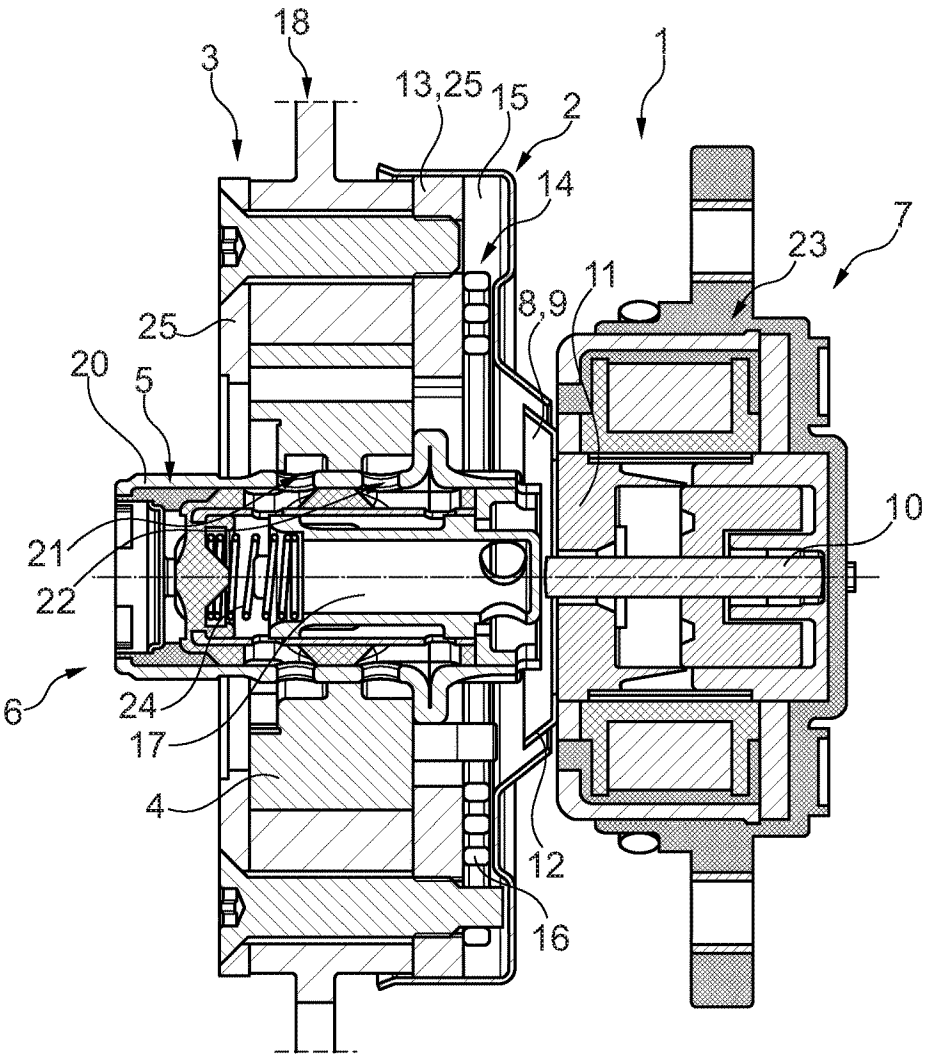
FIG. 1 a longitudinal section diagram through a camshaft adjusting system according to the invention according to a first embodiment along a rotational axis of a camshaft adjuster of the camshaft adjusting system, wherein, in particular, the configuration of a central valve of the camshaft adjuster and its arrangement relative to a magnetic actuator of the camshaft adjusting system comprising a hydraulic fluid guide section can be seen, FIG. 2 a longitudinal section diagram of the camshaft adjusting system according to the invention according to FIG. 1, wherein a schematically drawn flow of hydraulic fluid is guided from one of the two sub-chambers toward the magnetic actuator and in the radial direction back into the camshaft adjuster, FIG. 3 a longitudinal section diagram through a camshaft adjusting system according to another second embodiment, wherein the hydraulic fluid guide section is now an integral part of a bearing unit of the actuator, FIG. 4 a detail diagram of the camshaft adjusting system shown in FIG. 3 in the area of the central valve, wherein a first inlet of a first sub-chamber is opened to the surroundings and the flow of hydraulic fluid from the camshaft adjuster and also along the hydraulic fluid guide section is shown, and FIG. 5 a detail diagram according to FIG. 4, wherein now a second inlet of a second sub-chamber is opened to the surroundings, so that the flow of hydraulic fluid on the part of this sub-chamber is first guided out from the camshaft adjuster and fed by the hydraulic fluid guide section back to the camshaft adjuster.

In FIG. 1, a camshaft adjusting system 1 according to a preferred first embodiment is shown in a diagram. The camshaft adjusting system 1 consists of a camshaft adjuster 2 and an actuator 7 with an adjusting effect on this camshaft adjuster 2.

The camshaft adjuster 2 is here basically constructed as a hydraulic camshaft adjuster 2. The camshaft adjuster 2 is constructed according to the vane cell type/vane cell configuration. Accordingly, the camshaft adjuster 2 has an outer part designated as stator 3. The stator 3 is connected rotationally fixed to a traction mechanism, namely a chain, of a traction mechanism drive by a traction mechanism holder 18 when the internal combustion engine is in an operational state, wherein the traction mechanism is typically locked in rotation with a crankshaft of the internal combustion engine. The traction mechanism holder 18 is also designated as a drive wheel.

The stator 3 has, on its radial inner side, multiple pressure chambers that extend both in the radial direction and also in the circumferential direction and are not shown here for the sake of clarity.

A rotor 4 is supported so that it can rotate in the stator 3 over a certain range of angles/adjustment area. In each pressure chamber of the stator 3, a vane of the rotor 4 extends in the radial direction, wherein the vanes are also not shown in more detail for the sake of clarity. The vanes are mounted/fastened rotationally locked to the rotor 4. In an operational state, the rotor 4 is, in turn, rotationally locked with a camshaft of the internal combustion engine, also not shown here for the sake of clarity. The vanes of the rotor 4 thus extend into the pressure chambers of the stator, so that each pressure chamber is divided into two sub-chambers/sub-spaces hydraulically separated/sealed relative to each other, namely into a first sub-chamber and a second sub-chamber. These sub-chambers are hydraulically separated from each other in the circumferential direction by a vane. Together with the vanes, the rotor 4 can rotate relative to the stator 3 over the width of the pressure chamber in the circumferential direction.

Each sub-chamber of the pressure chambers interacts with a valve 5. The valve 5 is here oriented centrally, i.e., coaxial to the rotational axis 19 of the camshaft adjuster 2. The valve 5 is therefore also designated below as a central valve 5. The central valve 5 is part of a hydraulic control system 6. The central valve 5 has a valve housing 20 that is arranged radially within the rotor 4 and is rotationally locked with this rotor. Within the valve housing 20, a control slide 17 is supported so that it can move in the axial direction of the rotational axis 19. In particular, this control slide 17 can move between a first position and a second position, as described below with reference to the second embodiment. The central valve 5 is connected at an inlet with a hydraulic fluid source. The first sub-chamber of the camshaft adjuster 2 is connected to the control valve 5 by a first radial channel 21 in the form of a first hole and the second sub-chamber of the camshaft adjuster 2 is connected to the control valve 5 by a second radial channel 22 in the form of a second hole.

For adjusting the valve 5, the actuator 7 is provided in the camshaft adjusting system 1. The actuator 7 is here constructed as a magnetic actuator. This actuator 7 is mounted with its actuator housing 23 in the operational state on an area fixed to the internal combustion engine, for example, an internal combustion engine housing. The actuator 7 has a tappet 10 arranged in the axial direction and coaxial to the control slide 17/rotational axis 19. The tappet 10 can move in the axial direction. The tappet 10 interacts with an axial end side of the control slide 17, in order to move this back and forth between a first and a second position and thus specifying the position of the valve 5. A spring 24 in the form of a compression spring is, in turn, mounted on a side of the control slide 17 facing away from the tappet 10, in order to bring the control slide 17 back into its original position (the first position) after its adjustment by the tappet 10 into the second position.

The actuator 7 also has a bearing unit 11 that is arranged in the actuator housing 23 and is used for the movable support of the tappet 10. In this bearing unit 11, a pole winding is already formed, in order to have a shifting effect on the tappet 10 in the operational state by inducing a magnetic field.

Figure 2:
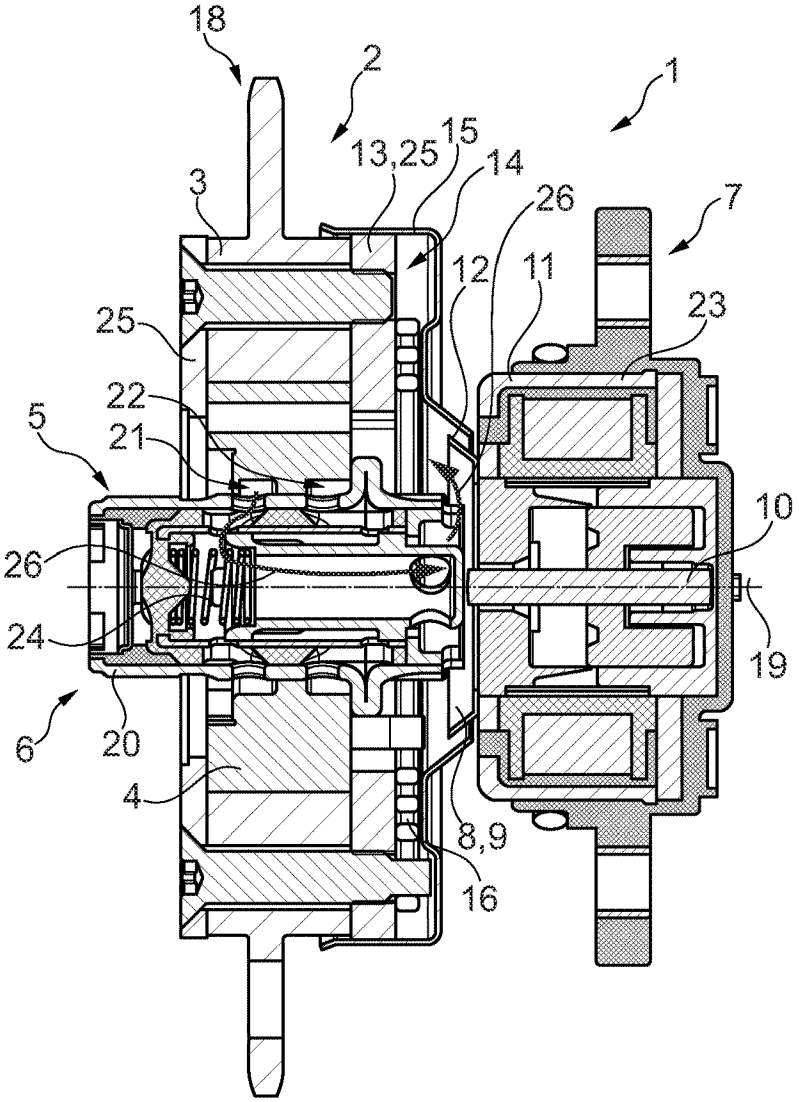

According to the invention, a hydraulic fluid guide section 8 is mounted on the actuator 7. In the embodiment according to FIGS. 1 and 2, the hydraulic fluid guide section 8 is formed as a deflection plate 9 that is produced separately from the actuator 7 and is connected to this actuator fixed to the housing. In particular, the hydraulic fluid guide section 8 is mounted in this embodiment fixed on the actuator housing 23. The hydraulic fluid guide section 8 has a ring-shaped construction. The hydraulic fluid guide section 8 is mounted on an axial side of the actuator housing 23 facing the camshaft adjuster 2 and also radially outside the tappet 10. The hydraulic fluid guide section 8 has a similarly ring-shaped collar 12 on a radial outer area. The collar 12 is mounted radially outside of the valve 5 so that a flow of hydraulic fluid 26 in an operational state, as can be seen especially well, in turn, in FIG. 2, exits from the valve 5/control valve in the axial direction and is fed by this collar 12 back to the camshaft adjuster 2 at a radially outer position after its exit from the valve 5.

Furthermore, a collection plate 15 is mounted on a stator-fixed area 13, here on a side cover 25 of the stator 3, wherein this collection plate 15 covers the hydraulic fluid guide section 8 radially from the outside. The flow of hydraulic fluid 26 that experiences a centrifugal force in the operational state of the camshaft adjuster 2 is guided back to the camshaft adjuster 2 in the axial direction by the collar 12. The collection plate 15 here has an essentially pot-shaped construction, wherein the hydraulic fluid guide section 8 extends with its collar 12 through a central opening.

Between itself and the stator 3, the collection plate 15 forms a hollow space 14. A return spring 16 of the camshaft adjuster is also arranged in this hollow space 14. This return spring 16 is here constructed as a spiral spring that is connected with one end fixed to the stator and with the other end fixed to the rotor, in order to rotate the stator and rotor 3 and 4 relative to each other in a non-pressurized state of the camshaft adjuster 2/hydraulic control system 6 into a preferred position.

The camshaft adjuster 2 also has a non-return valve in the form of a non-return flap also not shown in more detail for the sake of clarity. This is mounted preferably in the rotor, alternatively also in the stator. In this way, a hydraulic fluid volume collecting in the collection plate 15, which was previously guided there by the flow of hydraulic fluid 26, can move the non-return valve automatically into an opened position if there is sufficient pressure generated by the centrifugal force and can flow in the direction of the stator and/or rotor interior, for example, toward a reservoir in the rotor 4. The non-return valve is here mounted in the camshaft adjuster 2 so that a flow of the hydraulic fluid through this non-return valve from the rotor 4 is simultaneously prevented.

Figure 4:
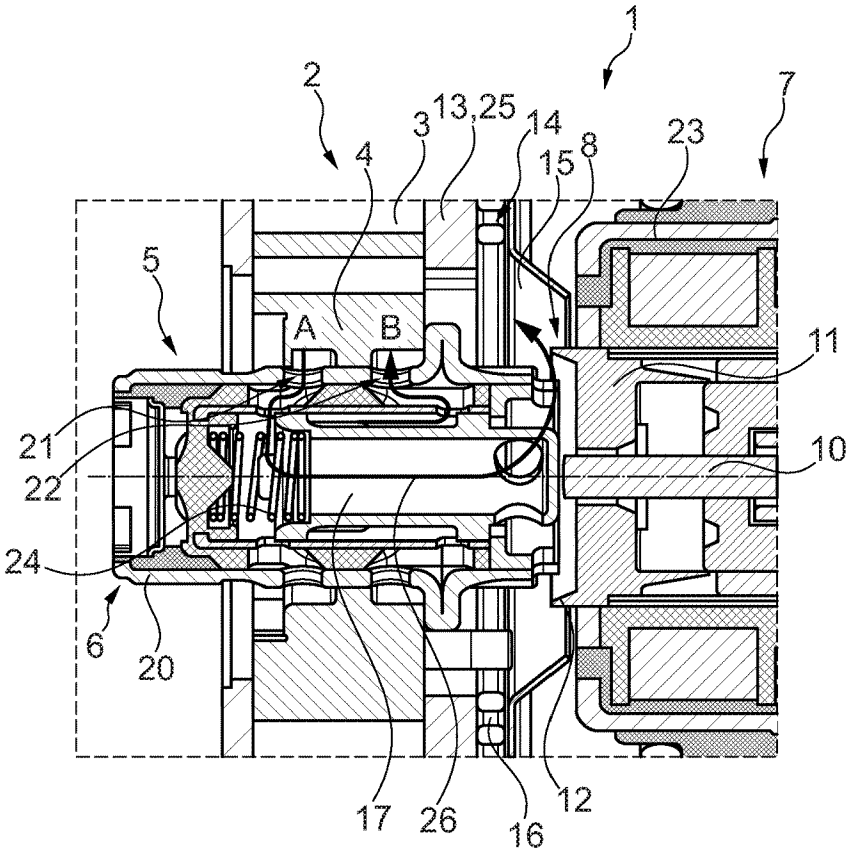
Figure 3:
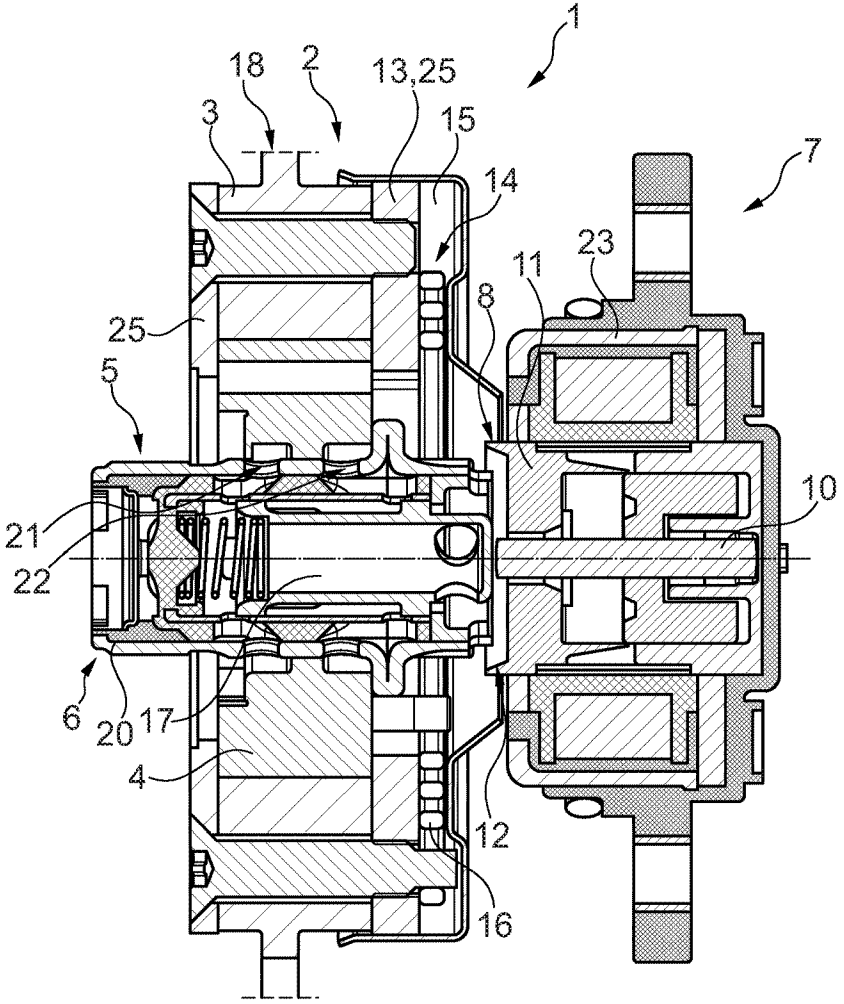
Figure 5:
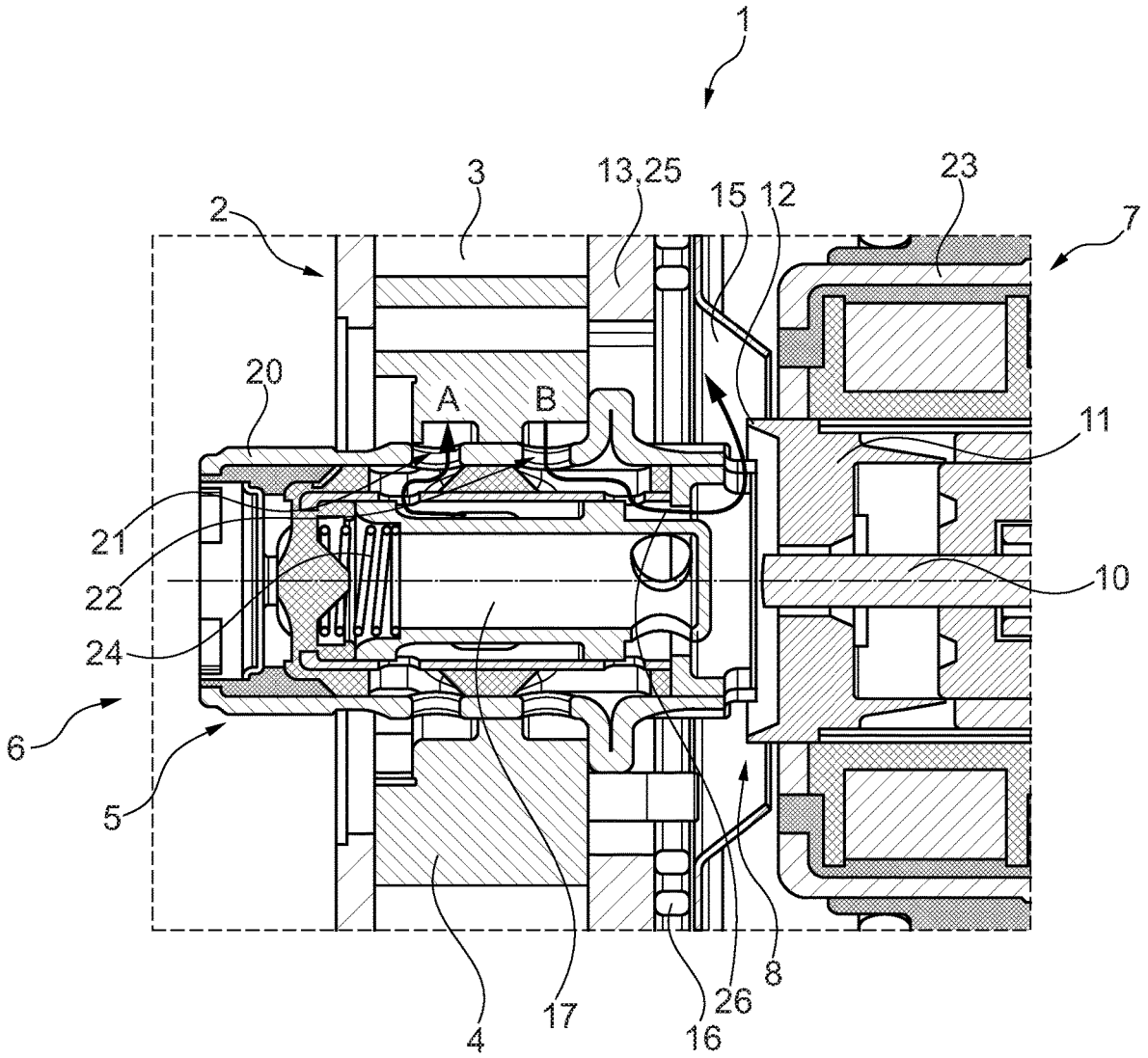

According to the second embodiment, as shown in FIGS. 3 to 5, however, the hydraulic fluid guide section 8 can also have a somewhat different construction. As can be seen in FIG. 3, the hydraulic fluid guide section 8 is constructed according to the second embodiment as an integral component of the bearing unit 11. The hydraulic fluid guide section 8 has, in turn, a collar 12 extending in the radial direction radially outside the control valve 5. The collar 12 is at a distance from an end side of the bearing unit 11 facing the camshaft adjuster 2 in the axial direction, so that the flow of hydraulic fluid 26 is fed, in turn, into the camshaft adjuster 2 as can be seen in FIGS. 4 and 5.

In FIG. 4, the first position of the valve 5 is shown schematically, while in FIG. 5 the second position of the valve 5 is shown. In the first position, the first channel 21 marked with "A" is opened to the surroundings of the camshaft adjuster 2, i.e., is essentially non-pressurized, while the second channel 22 marked with "B" is loaded with an inlet-side hydraulic fluid pressure of the valve 5, namely by a hydraulic fluid source. In this way, the volume of the first sub-chamber is minimized, while the volume of the second sub-chamber is maximized. This is the case, e.g., in an advanced position of the camshaft adjuster 2. In the second position according to FIG. 5, the first sub-chamber is connected to the hydraulic source and the second channel 22/the second sub-chamber is opened to the surroundings, i.e., non-pressurized. In this way, the volume of the second sub-chamber is minimized, while the volume of the first sub-chamber is maximized. This is the case, e.g., in a retarded position of the camshaft adjuster 2.

Expressed in other words, according to the invention a system design (camshaft adjuster system 1) is provided in which the oil (hydraulic fluid) exiting from the valve 5 is captured with a kind of funnel (collection plate 15) of the adjuster (camshaft adjuster 2) and is provided to the adjuster 2 again for later adjustment processes (smart phasing). In addition, a feature (hydraulic fluid guide section 8) is mounted on the central magnet (actuator 7), wherein this feature prevents the draining of the oil into the tank and provides a kind of "forced orientation" for the oil. The feature 8 can be implemented by the additional mounting of a component (guide plate 9) on the central magnet 7 or modifying a component located on the central magnet 7. In this way, the exiting oil is always captured or deflected and thus prevented from draining directly into the tank.

LIST OF REFERENCE SYMBOLS

1 Camshaft adjusting system
2 Camshaft adjuster
3 Stator
4 Rotor
5 Valve
6 Hydraulic control system
7 Actuator

8 Hydraulic fluid guide section
9 Deflection plate
10 Tappet
11 Bearing unit
12 Collar
13 Stator-fixed area
14 Hollow space
15 Collection plate
16 Return spring
17 Control slide
18 Traction mechanism holder
19 Rotational axis
20 Valve housing
21 First channel
22 Second channel
23 Actuator housing
24 Spring
25 Side cover
26 Flow of hydraulic fluid

The invention claimed is:

1. A camshaft adjusting system for an internal combustion engine of a motor vehicle, the camshaft adjusting system comprising:

a hydraulic camshaft adjuster including:

a stator, a rotor that is rotatably mounted in the stator, a hydraulic control system that comprises a valve arranged coaxial to a rotational axis of the hydraulic camshaft adjuster, a pressure chamber formed between the rotor and the stator, and at least one vane on the rotor extends into the pressure chamber such that said pressure chamber is divided into two sub-chambers, each of the two sub-chambers interact with the hydraulic control system such that a hydraulic pressure ratio is established between the two sub-chambers, said hydraulic pressure ratio specifying a relative rotational position between the rotor and the stator, and is adjusted based on a position of the valve;

an actuator arranged adjacently in an axial direction of the hydraulic camshaft adjuster and which acts on the valve for adjusting purposes;

a hydraulic fluid guide section formed as a deflection plate and arranged on a side of the actuator facing the hydraulic camshaft adjuster, said hydraulic fluid guide section including a flange arranged at an angle relative to the rotational axis of the hydraulic camshaft adjuster and being designed to deflect a flow of hydraulic fluid exiting the valve into surroundings of the hydraulic camshaft adjuster back into the hydraulic camshaft adjuster in an operational state; and a collection plate that forms a hollow space and covers the hydraulic fluid guide section radially from an outside in the axial direction mounted on a stator-fixed area of the hydraulic camshaft adjuster, the collection plate including an end flange that overlaps with the flange of the hydraulic fluid guide section and is angled relative to the rotational axis of the hydraulic camshaft adjuster, wherein an opening is defined between the end flange of the collection plate and the flange of the hydraulic fluid guide section.

2. The camshaft adjusting system according to claim 1, further comprising a return spring pretensioning the rotor relative to the stator in a rotational direction arranged in the hollow space.

3. The camshaft adjusting system according to claim 1, wherein the valve is a central valve that is housed radially within the rotor.

4. The camshaft adjusting system according to claim 1, wherein the valve is constructed so that in a first position of a control slide of the valve, a first sub-chamber is opened hydraulically to the surroundings and in a second position of the control slide, a second sub-chamber is opened hydraulically to the surroundings.

5. The camshaft adjusting system according to claim 1, wherein the deflection plate is ring-shaped.

* * * * *